US006450105B1

(12) United States Patent
Glass

(10) Patent No.: US 6,450,105 B1
(45) Date of Patent: Sep. 17, 2002

(54) LADING PROTECTOR FOR CENTERBEAM RAIL CARS

(75) Inventor: Barry T. Glass, Crest Hill, IL (US)

(73) Assignee: Ireco, Inc., Chicago, IL (US)

( * ) Notice: Subject to any disclaimer, the term of this patent is extended or adjusted under 35 U.S.C. 154(b) by 0 days.

(21) Appl. No.: 09/397,681

(22) Filed: Sep. 16, 1999

(51) Int. Cl.[7] ..... B61D 17/00
(52) U.S. Cl. ..... 105/404
(58) Field of Search ..... 105/238.1, 396, 105/404, 407, 416

(56) References Cited

U.S. PATENT DOCUMENTS 4,753,175 A * 6/1988 Harris et al. ..... 105/355
4,784,067 A * 11/1988 Harris et al. ..... 105/355
4,802,420 A * 2/1989 Butcher et al. ..... 105/355
5,024,567 A * 6/1991 Dominquez et al. ..... 410/100
5,899,646 A 5/1999 Tatina et al.

* cited by examiner

*Primary Examiner*—S. Joseph Morano
*Assistant Examiner*—Robert J. McCarry, Jr.
(74) *Attorney, Agent, or Firm*—Cook, Alex, McFarron, Manzo, Cummings & Mehler, Ltd.

(57) ABSTRACT

Lading protectors for mounting between the upper ends of adjacent columns positioned along the centerline of a centerbeam rail car. Each protector comprises a pair of parallel and upright lading engaging side plates supported on opposite sides of a horizontal elongated stiffener plate. The side plates are bent at the bottoms and ends so as to avoid exposure of free edges to the lading. The outer surfaces of the side plates are located appreciably outside the adjacent surfaces of the columns they extend between so that the lading engages the side plates and not the columns.

10 Claims, 3 Drawing Sheets

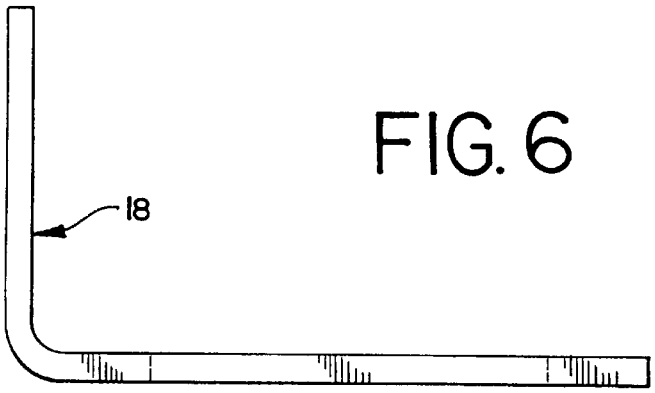
FIG. 6
FIG. 7
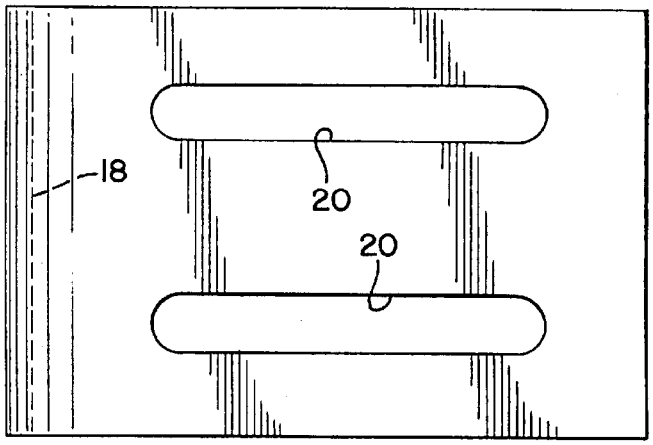
FIG. 8
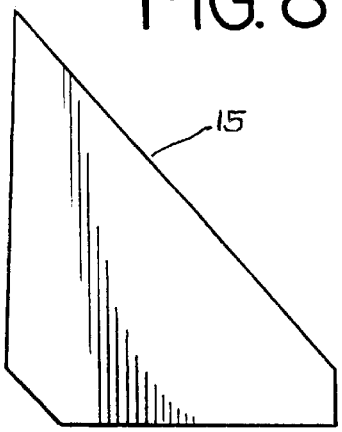
FIG. 9
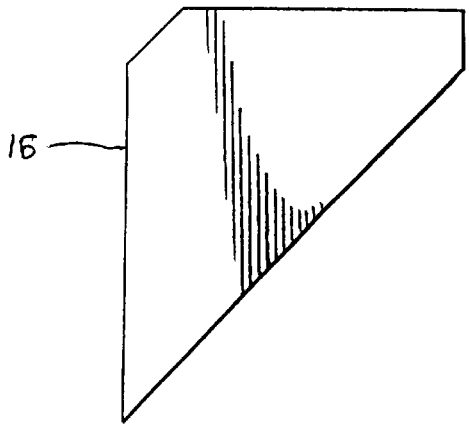

LADING PROTECTOR FOR CENTERBEAM RAIL CARS

BACKGROUND AND DESCRIPTION OF THE INVENTION

This invention relates to lading protectors for use in protecting lading loaded onto centerbeam rail cars having bulkheads located at opposite ends of each deck and a row of regularly spaced columns or posts extending between the bulkheads along the longitudinal centerline of the car. The columns are usually in the form of channels with their open sides oriented in the direction of the centerline of a car. The columns from bottom to top do not have uniform width but taper outwardly appreciably toward the bottom at a small angle, e.g., 1.4°. The upper portions of lading loaded on the decks of centerbeam cars usually get forcibly winched against opposite sides of the columns adjacent their top ends. When the lading is in the form of a material such as lumber the engagement between the upper bundles of lumber and the columns adjacent their top ends results in the wearing of grooves into the lumber. Such grooves are objectionable and diminish the quality and value of the lumber into which the grooves have been worn. Other forms of lading are also subject to the same abuse.

The object of the invention, generally stated, is the provision of lading protectors for use with centerbeam rail cars equipped with a centerline row of columns.

A further object of the invention is the provision of such lading protectors which are economical and durable and readily installable in existing centerbeam rail cars the cargo decks of which are equipped with the usual centerline rows of columns.

For a more complete understanding of the nature and scope of the invention reference may now be had to the following and detailed description of a presently preferred embodiment taken in connection with the accompanying drawings in which:

BRIEF DESCRIPTION OF DRAWINGS

FIG. 6 is a side elevational view of a mounting bracket used to mount an end of the lading protector of FIGS. 2–4 to one of the adjacent columns;

FIG 7 is a top plan view of the bracket shown in FIG. 6;

FIG. 8 is a side elevational view of one of a plurality of top reinforcement gussets used in the lading protector of FIGS. 2–4; and FIG. 9 is a side elevational view of a bottom reinforcement gusset used in the lading protector of FIGS. 3–4.

Referring to FIG. 1, the floor or deck and superstructure of a centerbeam railway car is indicated generally at 5 with the floor or deck indicated at 6. Bulkheads at the opposite ends of the car are indicated at 7—7 with columns indicated at 8—8 extending down the longitudinal centerline of the car between the bulkheads 7. A plurality of lading protectors indicated generally at 10 are shown mounted between a plurality of adjacent columns 8. A header 11 in the form of a rectangular beam (FIG. 4) is mounted on the upper ends of the columns 8 and serves to rigidify the assembly shown in FIG. 1.

Referring to FIGS. 2–4, each lading protector 10 made in accordance with the present invention comprises a pair of elongated side plates 12—12 the opposite ends 13 of which are bent inwardly so as to fit around the four beveled corners at the ends of a stiffener plate 14 and thereby avoid exposure of any sharp edges which lading might contact. The opposing longitudinal side edges of the horizontal stiffener 14 are secured by welding or other means to the side plates 12 at approximately their longitudinal centerlines and thereby serve to join the side plates 12 together in a generally parallel and upright orientation while accommodating the slight taper (e.g., 1.4°) toward the bottoms of the center posts. The structure is further rigidified by welding or otherwise securing a plurality of upper gusset plates 15—15 (FIG. 8) and a plurality of lower gusset plates 16—16 (FIG. 9). The bottom edges of the side plates 12 are bent inwardly as indicated at 17 (FIG. 4) so as to avoid contacting and damaging lading.

Each lading protector 10 is connected to and supported on the adjacent columns 8 by a pair of right angle brackets 18—18 (FIGS. 6 and 7). The horizontal legs of the brackets 18 are provided with parallel elongated slots 20—20 which accommodate nuts and bolts 21—21 (FIGS. 3–4). As shown in FIG. 5 the opposite ends of the stiffener plate 14 are provided with openings 22—22 which accommodate fasteners 21 in the form of nuts and bolts 21. Gussets 23—23 (FIGS. 2, 3 and 4) serve to reinforce the brackets 18.

Figure 3:
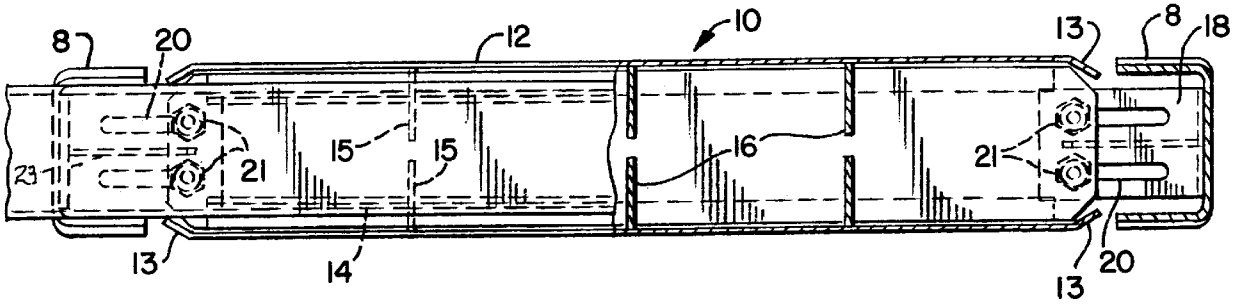
FIG. 3 is a combined top plan and sectional view taken on line 3—3 of FIG. 2.
Figure 4:
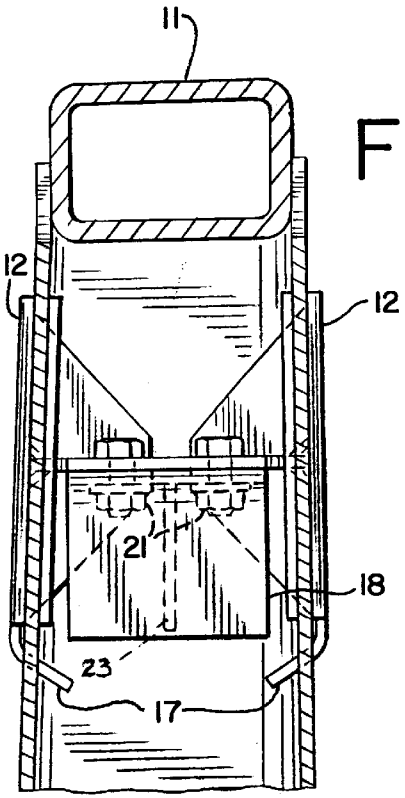
FIG. 4 is a vertical sectional view taken on line 4—4 of FIG. 2.
Figure 5:
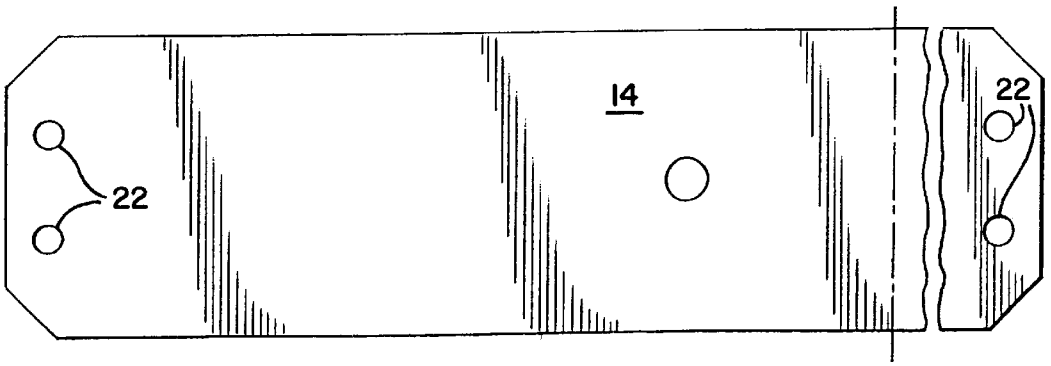
FIG. 5 is a fragmentary plan view of a stiffener plate forming a part of the lading protector shown in FIGS. 1–4.

It will be apparent from FIGS. 3 and 4 that the outer surfaces of the side plates 12 are located outboard of the outer side surfaces of the columns 8 thereby preventing lading loaded on the floor 6 from engaging the columns 8.

It will be seen that once the lading protectors 10 are assembled they can be readily installed between adjacent columns 8 by means of the mounting brackets 18. By reason of the elongated slots 20 it will be seen that the lading protectors 10 can be located between a pair of columns 8 with their open sides facing each other as shown, or between a pair of columns 8 the closed sides of which face each other, or between the open side of one column and the closed side of an adjacent column.

Figure 1:
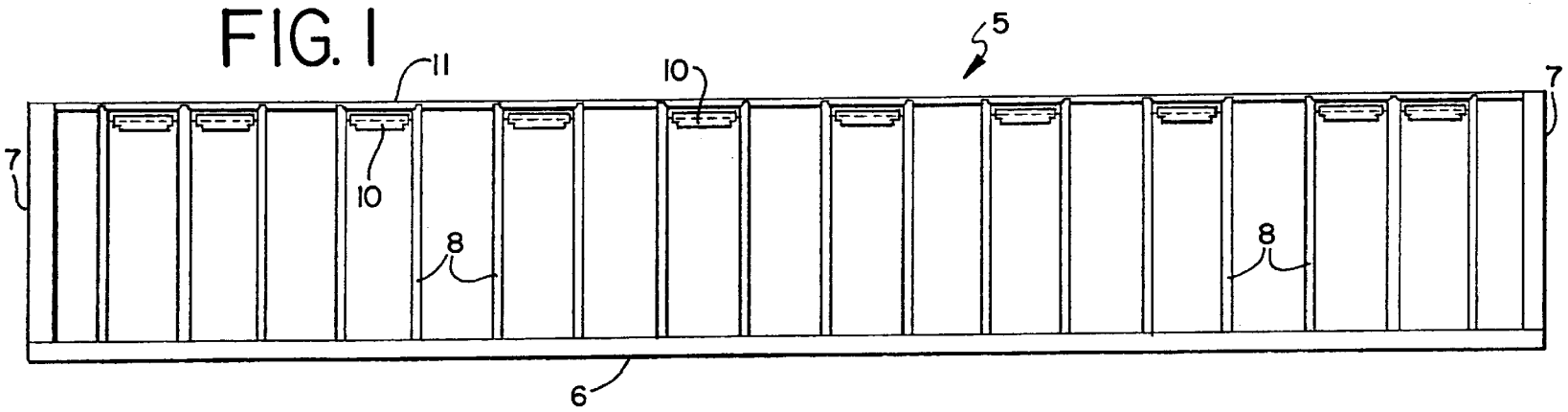
FIG. 1 is a schematic side elevational view showing the floor or deck of a representative centerbeam rail car having bulkheads at opposite ends and a row of columns extending along the centerline of the car between the bulkheads and showing a series of Applicant's lading protectors installed between the upper ends of adjacent pairs of columns.
Figure 2:
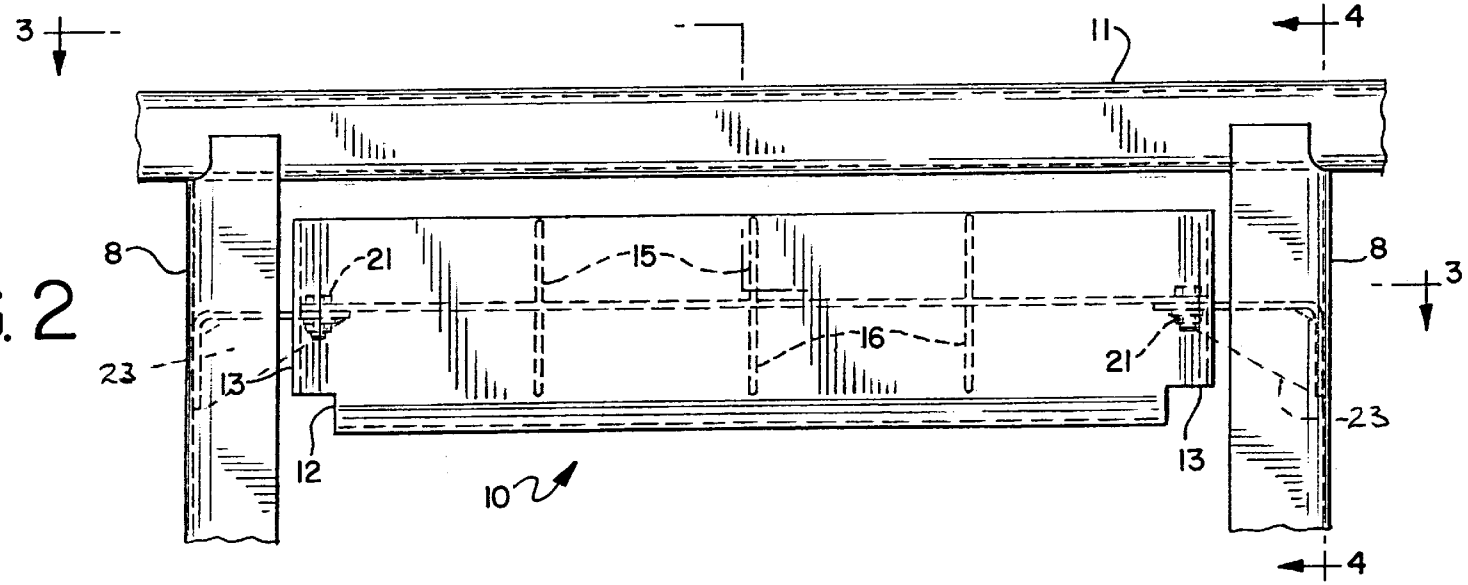
FIG. 2 is an enlarged side elevational view of one of the lading protectors shown in FIG. 1.

In use, as illustrated in FIG. 1, it is not usually required that a lading protector 10 be located between the upper ends of each and all of adjacent pairs of columns 8.

What is claimed is:

1. A centerbeam rail car comprising:

a rail car flat bed on which cargo is loaded, bulkheads at opposite ends of the rail car flat bed, a row of regularly spaced upright columns extending between the bulkheads, each column having an upper end portion, a plurality of lading protectors mounted between and adjacent respective said upper ends of at least a plurality of said columns, and the opposing lateral surfaces of said lading protectors project appreciably beyond the adjacent lateral surfaces of the upper ends of said columns and prevent lading from engaging said columns.

2. The rail car of claim 1, wherein said row of columns extends along at least approximately the longitudinal centerline of said flat bed.

3. The rail car of claim 1, wherein the lading protector includes elongated side plates, an elongated stiffener plate disposed horizontally between said side plates, and brackets for attaching the opposite ends of said lading protector to said upright columns.

4. The rail car of claim 3, wherein the opposite ends of said side plates are bent inwardly to prevent the end edges from engaging lading.

5. The rail car of claim 4, wherein the bottom of each said side plate is bent inwardly to prevent the bottom edge from engaging lading.

6. The rail car of claim 3, wherein the bottom of each said side plate is bent inwardly to prevent the bottom edge from engaging lading.

7. A lading protector comprising:

a pair of elongated side plates which in use are at least approximately parallel and upright, an elongated stiffener plate disposed horizontally between said side plates with its opposite longitudinal edges joined to and connecting said side plates approximately halfway between their upper and lower longitudinal top and bottom edges, a plurality of longitudinally spaced gussets interconnecting said side plates and said stiffener plate, and brackets for attaching the opposite ends of said stiffener plate between a juxtaposed pair of upright columns extending between bulkheads of a centerbeam rail car.

8. A lading protector as called for in claim 7 wherein the opposite ends of said side plates are bent inwardly to prevent the end edges from engaging lading.

9. A lading protector as called for in claim 8, wherein the bottom of each said side plate is bent inwardly to prevent the bottom edge from engaging lading.

10. A lading protector as called for in claim 7 wherein the bottom of each said side plate is bent inwardly to prevent the bottom edge from engaging lading.

* * * * *